US007338008B1

(12) United States Patent
Jenkins

(10) Patent No.: US 7,338,008 B1
(45) Date of Patent: Mar. 4, 2008

(54) ROLL TRASH BAG DISPENSER

(76) Inventor: Phillip Jenkins, 230 Briarfield Rd., Scottsville, KY (US) 42164

( * ) Notice: Subject to any disclaimer, the term of this patent is extended or adjusted under 35 U.S.C. 154(b) by 798 days.

(21) Appl. No.: 10/892,949

(22) Filed: Jul. 16, 2004

(51) Int. Cl.
*B65H 16/02* (2006.01)

(52) U.S. Cl. ..... 242/595

(58) Field of Classification Search ..... 242/595, 242/596.8, 597.8, 598.5, 598.6; 312/34.8
See application file for complete search history.

(56) References Cited

U.S. PATENT DOCUMENTS 477,512 A * 6/1892 Combis et al. ..... 242/595
1,151,887 A * 8/1915 Liebeck ..... 242/595
1,609,862 A * 12/1926 Clifford ..... 242/595
4,830,301 A * 5/1989 Miller ..... 242/595
5,109,978 A 5/1992 Cawley
5,255,800 A * 10/1993 Kelly ..... 242/595
5,425,513 A 6/1995 Shainker
5,611,455 A 3/1997 McCreary
5,642,810 A 7/1997 Warner et al.
5,868,346 A * 2/1999 Cobos ..... 312/34.8
6,283,405 B1 9/2001 Tracy

* cited by examiner

*Primary Examiner*—William A Rivera
(74) *Attorney, Agent, or Firm*—Dennis G. LaPointe

(57) ABSTRACT

The invention is a dispenser for plastic bags on a roll. The invention consists of a rectangular base for mounting beneath a cabinet through a plurality of mounting holes and a tubular body attached to the bottom of the base. The tubular body has an opening on one end for inserting the roll of bags and a dispensing opening on one side, directly below the base.

1 Claim, 3 Drawing Sheets

ROLL TRASH BAG DISPENSER

BACKGROUND OF THE INVENTION

1. Field of the Invention

This invention relates to a dispenser for trash container liners and, more particularly, to such a dispenser which can be fastened under a cabinet or to a wall without requiring any modification to the trash container.

2. Background of the Invention

It is common to use plastic liners for lining the inside of trash containers or garbage cans. The liners are usually packaged in boxes or in rolls. A liner is removed from the box or roll and placed in the trash container to line its inside. After the liner is filled with trash, it is removed from the trash container and discarded, and a new liner is then removed from the package and inserted into the trash container. Typically, the packages of trash can liners are stored in a closet or on a shelf, and a new liner must be obtained from the package before insertion into the trash container.

U.S. Pat. No. 6,283,405 to Tracy discloses a dispenser for trash container liners including a rigid triangular box containing a supply of liners in the form of a cylindrical roll of a continuous strip of liners. The liners extend through an open slot in a side of the box and the innermost liner of the roll is securely attached to a cylindrical spindle on which the liners are wound. The box is detachably secured to the bottom of the trash container and the spindle is dimensioned so as not to pass through the slot.

U.S. Pat. No. 5,642,810 to Warner et al. discloses a dispenser for rolled plastic bags including a container dispenser in the general form of an upright cylinder of clear semi-rigid plastic having two halves hinged about a diametrical edge at the bottom of the container. Feet are formed in the bottom wall, extending transverse to the hinge, and cooperating with the hinge to provide a base support so that the package may be stored and displayed in an upright position. An elongated recess is formed in the cylindrical wall of the container, with a die-cut strip.

U.S. Pat. No. 5,425,513 to Shainker discloses a bag dispenser package including a T-shirt bag having a roll of continuous plastic bags. When the leading bag is pulled from the roll and out the mouth of the T-shirt bag, the roll rotates within the T-shirt bag in an arrangement which provides controlled dispensing of the trash bags.

U.S. Pat. No. 5,611,455 to McCreary discloses a dispenser and method for dispensing individual sheets from continuous bulk material consisting of a relatively heavy, free standing dispenser. The roll is supported in a vertical position and is unwound by a steady force applied to the running end which extends through an opening of the dispenser. The mass of the dispenser acts through the roll on the running end to oppose this force causing each sheet to separate cleanly beyond the opening.

U.S. Pat. No. 5,109,978 to Cawley discloses a dispenser for plastic bags having four walls, a bottom connecting with the four walls, and an open top. One of the four walls is a front wall which is oriented at an angle away from an oppositely situate back wall. A small separation between the upper edge of the front wall and the top forms a slit through which plastic bags are dispensed. An opening in the top is dimensioned to permit a roll of plastic bags to be dropped into the interior of the dispenser, and thereupon rest upon skids located on the bottom.

SUMMARY OF THE INVENTION

According to the present invention, there is provided a dispenser for plastic bags on a roll which comprises a rectangular base for suspending a hollow dispenser from the bottom of a hanging cabinet or attaching the dispenser to a wall or other vertical support. The rectangular base contains a plurality of mounting holes for mounting the dispenser. A hollow trash bag dispenser is attached to the bottom surface of the rectangular base. The dispenser is a hollow tube having an opening at a first end and sealed at a second end. The opening at the first end is used for loading the plastic bags into the dispenser. An elongated, rectangular opening is formed on a first side of the tube, directly below the rectangular base near the point of attachment of the tube and base. The rectangular opening is provided for dispensing the trash bags from the roll. The dispenser of the invention may be made from plastics such as polyethylene, lexan, etc., or metal such as aluminum.

BRIEF DESCRIPTION OF THE DRAWINGS

The following will be more readily apparent upon reading the following description in conjunction with the drawings in which like elements in different figures thereof are identified by the same reference numeral and wherein.

DETAILED DESCRIPTION OF THE INVENTION

Figure 1:
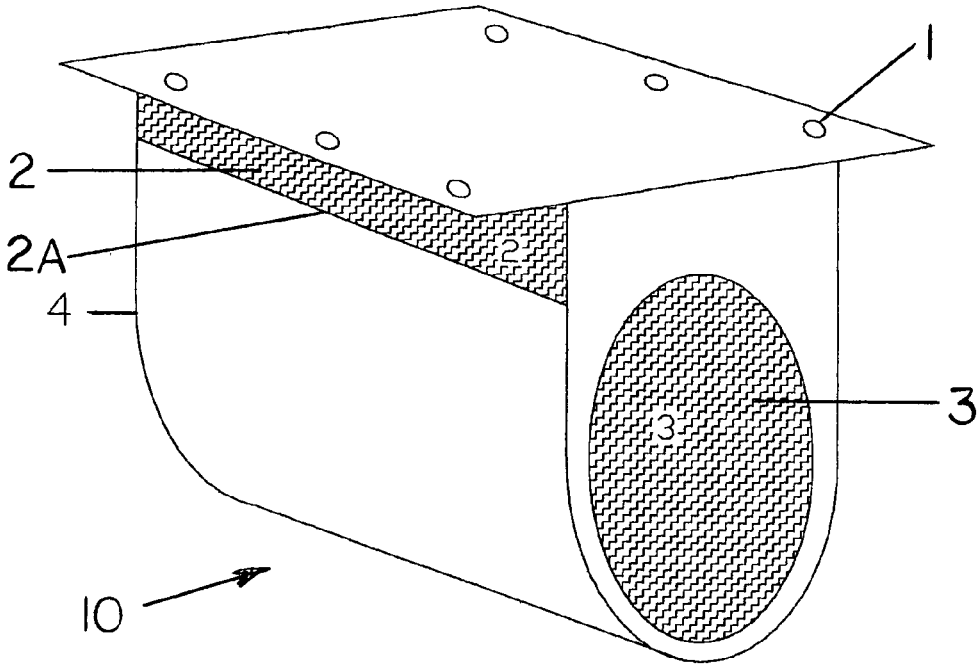
FIG. 1 is a perspective view of a dispenser constructed according to the present invention.
Figure 2:
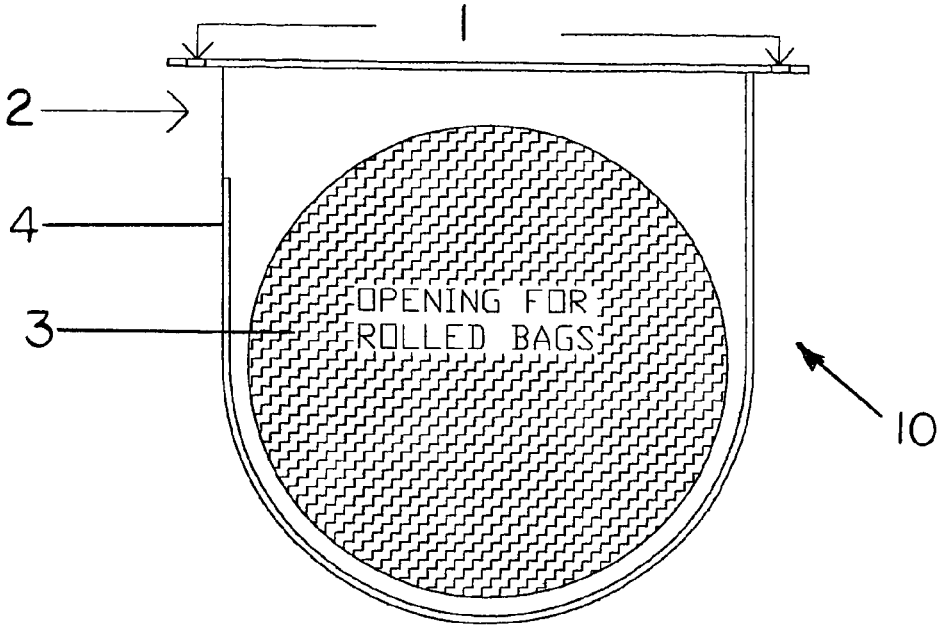
FIG. 2 is a side view showing the opening for loading rolled bags.

FIGS. 1 and 2 show a dispenser, designated generally by the reference numeral 10, constructed in accordance with the present invention. The dispenser 10 includes a tubular shaped hollow body 4 having an opening 2 in front for the bags (not shown) to hang out. The body 4 is attached to a rectangular base 9. The opening 2 is formed in the body 4 between the base 9 and the bottom edge 2A of the opening 2. The opening 2 has sufficient height and width to pass the bags as they are unrolled from within the hollow body 4.

The base 9 has a plurality of mounting holes 1 formed on opposite sides. With the bag hanging out of the opening 2, the bag to be dispensed is pulled downwardly over the bottom edge 2A of opening 2. The bottom edge 2A of opening 2 is used as a separating edge for separating the desired bag from the roll of bags contained in the dispenser 10.

An opening 3, for inserting the rolled plastic bags, is provided on a first end of the body 4. The second end (not shown) is a solid wall. The entire roll of bags is inserted through the opening 3 and the lead bag is threaded through the opening 2 for dispensing.

Figure 3:
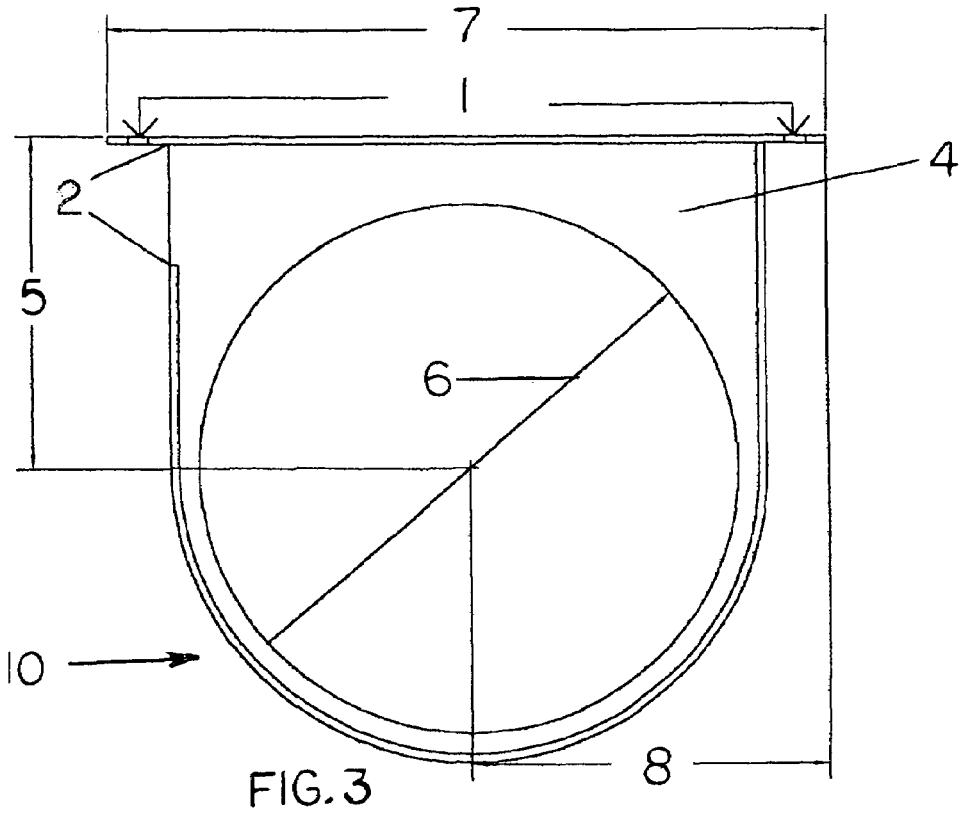
FIG. 3 is a side view showing the dimensions of a preferred embodiment of the dispenser according to the present invention.
Figure 4:
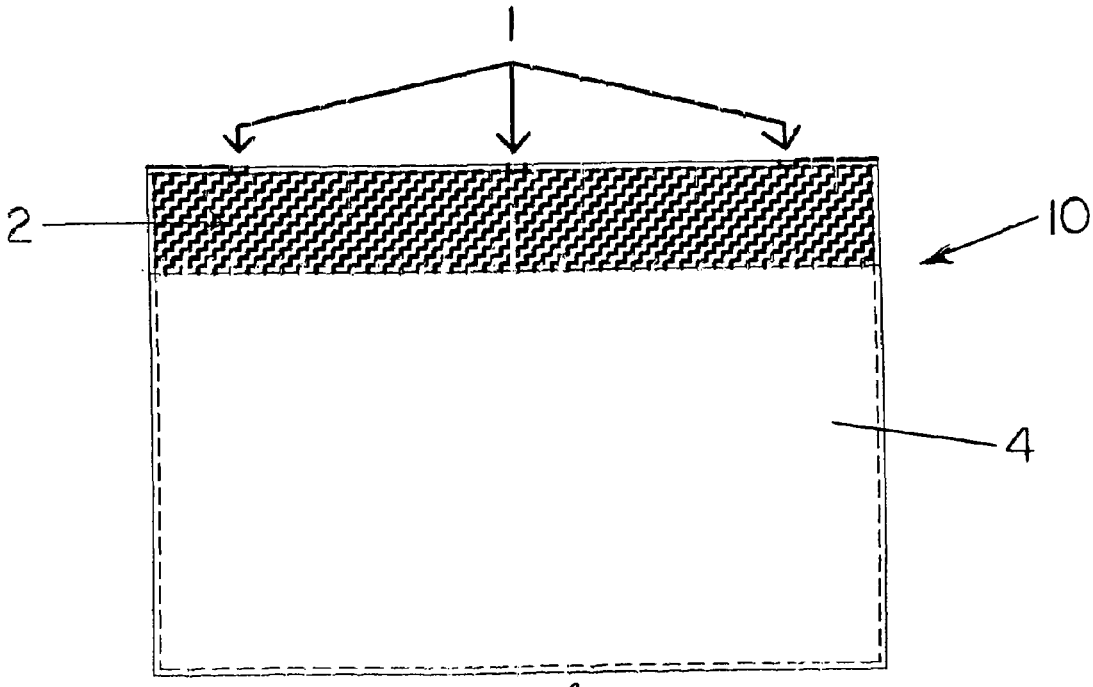
FIG. 4 is a side view showing the rectangular opening for dispensing the bags.
Figure 5:
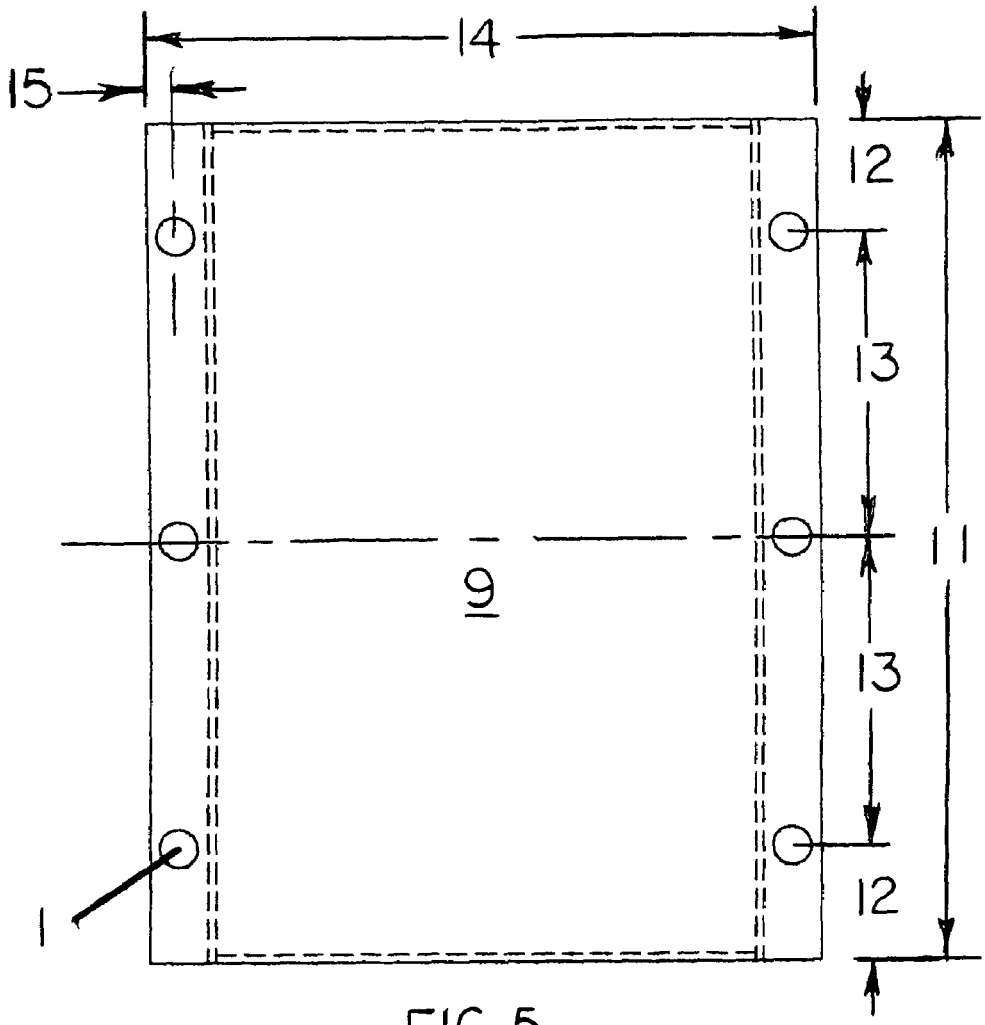
FIG. 5 is a top view of the rectangular base showing the dimensions and the locations of the mounting holes.

FIGS. 3-5 show the detailed views of the sections of the dispenser 10. FIG. 3 is a side view showing the dimensions of a preferred embodiment of the dispenser 10. FIG. 3 is a side view of the dispenser 10 with the following dimensions:

Width 7—8.7000 inches;

Diameter 6—6.5000 inches;

Center Line 8, of opening 3 from back edge of base 9—4.3500 inches;

Center Line 5, of opening 3 from front edge of base 9—4.1000 inches;

FIG. 4 is a side view showing the location of the opening 2.

FIG. 5 is a top view of the rectangular base 9 with the locations of the mounting holes 1.

Following is a list of the various dimensions:

Length 11, 11 inches;

Length 12, 1.5 inches;

Length 13, 14 inches;

Length 14, 8.7 inches, and

Length 15, 0.375 inches.

The dispenser 10 will mount on a wall or under a shelf by using six 8¾" long pan head screws. To load the dispenser 10, unroll the trash bag 1 to 1½ feet. First put the end of the bag through round opening 3 at the end of the dispenser 10 with bag started; push the bag through the front opening 2. After the bag is started through the front, hold the bag and put the roll in the dispenser 10 through the round opening 3 at the end of the dispenser 10 Pull the bag out until perforation is 6" out of the dispenser 10 and tear off the bag and you are ready for the next time.

Accordingly, there has been disclosed an improved dispenser for trash bags. While a preferred embodiment of the present invention has been disclose herein, it will be appreciated by those of skill in the art that various adaptations and modifications to the disclosed embodiment are possible, and it is therefore intended that this invention be limited only by the scope of the appended claims. Thus the present invention can be manufactured in many different sizes, to fit different sized conventional trash bags, without requiring the use of a specially designed container.

What is claimed is:

1. A dispenser for plastic bags on a roll, said dispenser comprising:

a rectangular base having a top side and a bottom side and a plurality of mounting holes formed therein, said mounting holes formed on opposite sides of said rectangular base, a tubular shaped body attached to said bottom side of said base, said tubular body having a first end and a second end, said body having a first opening formed in said first end for inserting a roll of plastic bags, a second end being a solid wall, said tubular shaped body having a second opening formed therein, said base forming a top edge for said second opening and said body forming a bottom edge for said second opening, said second opening having sufficient height and width to pass the bags as they are unrolled from within said hollow body.

* * * * *